US005108794A

United States Patent [19]

Kinnunen

[11] Patent Number: 5,108,794

[45] Date of Patent: Apr. 28, 1992

[54] METHOD FOR COMPENSATION OF DOCTOR BLADE DEFLECTION

[75] Inventor: Jorma Kinnunen, Järvenpää, Finland

[73] Assignee: Valmet Paper Machinery Inc., Helsinki, Finland

[21] Appl. No.: 423,340

[22] Filed: Oct. 17, 1989

[30] Foreign Application Priority Data

Nov. 18, 1988 [FI] Finland ..... 885372

[51] Int. Cl.[5] ..... B05D 3/12

[52] U.S. Cl. ..... 427/356; 118/126; 162/361; 427/444

[58] Field of Search ..... 427/356, 357, 358, 444; 118/126, 261, 413, DIG. 15; 101/156, 157, 168, 169; 162/361

[56] References Cited

U.S. PATENT DOCUMENTS

| | | | |
|---|---|---|---|
| 3,748,686 | 7/1973 | Winterburn et al. | 15/256.51 |
| 3,955,531 | 5/1976 | Brown | 118/261 |
| 4,331,713 | 5/1982 | Girard et al. | 427/356 |
| 4,367,120 | 1/1983 | Hendrikz | 162/281 |
| 4,373,445 | 2/1983 | Köbler | 118/261 |
| 4,665,859 | 5/1987 | Dunlap et al. | 118/126 |
| 4,907,528 | 3/1990 | Sollinger | 118/126 |

FOREIGN PATENT DOCUMENTS

| | | |
|---|---|---|
| 57290 | 3/1980 | Finland . |
| 72364 | 1/1987 | Finland . |

*Primary Examiner*—Shrive Beck
*Assistant Examiner*—Terry J. Owens

[57] ABSTRACT

A deflection compensated doctor blade (1) and method for coating a moving web and scraping a backing member (5). The deflection of the doctor blade is compensating by first determining the deflection of the doctor blade and then adapting appropriately selected, non-continuous forces to be exerted on the doctor blade (1) so as to achieve by these forces such deformations in the doctor blade that have an equal magnitude but an opposite direction in relation to those caused by blade loading on the doctor blade (1). This approach results in the nullification of the superimposed deflection (11). The forces are adapted to be exerted at a determined distance (RT) from the pivotal bearing points of the doctor blade (1) and at a determined distance (RV) from the pivotal axis (3) of the doctor blade.

7 Claims, 2 Drawing Sheets

METHOD FOR COMPENSATION OF DOCTOR BLADE DEFLECTION

FIELD OF THE INVENTION

The present invention relates to a method for the compensation of doctor blade deflection.

The invention also concerns a deflection-compensated doctor blade.

DESCRIPTION OF THE BACKGROUND ART

A paper web and similar materials handled in sheet form are coated by applying onto a moving material web a coating mix which then is spread into an even layer onto the web surface with the help of a doctor blade. In the coating unit the material web to be coated passes between the doctor blade and a suitable backing member, conventionally a rotating roll. The blade doctors the excess coating mix from the web and levels the coating into an even layer on the web. In order to achieve a layer as even as possible, the gap formed between the web and the blade should have a constant spacing in the cross direction of the web over its entire width. The pressure applied to press the blade against the web should be high and constant over the entire length of the blade in order to attain an even spreading of the coating mix onto the web rotating at high web speeds.

For several reasons, the spacing of the gap between the material web and the doctor blade cannot be maintained exactly constant. During machining, the doctor blade and its frame are fixed to the machining unit base with strong clamps into a position simulating their operating position. Thus, the doctor blade frame is subjected to approximately the same forces as those exerted on it by its weight alone in its operating position. Despite the exact placement of the clamps, defects will develop during fabrication of the doctor blade and its frame causing a parallelism error to appear between the web surface and the doctor blade edge. As the doctor blade of the coating unit is pressed against the moving web, the blade is loaded with a linear force. Due to the pivotal support of the doctor blade frame by means of bearings mounted at both ends of the frame, the deflection induced by the linear load force at the center of the blade will be greater than at the supported ends, whereby the spacing of the blade from the web will be smaller at the edges of the web than at the center. Since the linear force exerted by the blade onto the web or the surface of the backing roll is smaller in the middle in comparison to the ends, any possible bumps on the web as well as variations in coating mix density and viscosity can lift the blade away from the web.

In order to alleviate the aforementioned disadvantages, several different solutions for the attachment of the doctor blade have been presented. In the prior-art constructions, a homogeneous loading of the blade over the entire web width has been attempted by means of a flexible blade and an adjustable blade holder element. In these embodiments, the blade is attached to the blade holder so that the blade can be pressed against the web by means of a flexible element, e.g., a pneumatically or hydraulically filled rubber hose, which extends across the entire length of the blade. Because of the equal pressure prevailing along the hose, the blade is pressed against the web with a constant linear force over the entire width of the web. The blade pressure against the web can then be adjusted by altering the pressure in the hose. These kinds of embodiments often use a doctor blade which is divided into smaller sections along its length. The advantage of this solution is a more flexible blade capable of higher compliance with the shape of the web and the roll.

Embodiments of the type described above are disclosed in, e.g., patent publications FI 842626, FI 57290, U.S. Pat. No. 3,748,686 and U.S. Pat. No. 4,367,120.

The described solutions carry several disadvantages. Because of the limited deformation capability of the flexible support member, this solution is incapable of compensating for large variations in the spacing between the blade and the web as well as in blade loading. The adjustment range of blade loading remains restricted and, if a higher coating speed is desired, the blade must be pressed against the web with an actuator element attached to the doctor blade. A higher blade loading results in an increased stiffness of the blade holder element, whereby the blade becomes incapable of complying with the web surface in the desired manner. The frame of the doctor blade must be constructed extremely stiff in order to make it possible to compress the flexible blade against the web. A blade consisting of a plurality of narrow sections in a comb-like manner is not compatible with all types of coating applications. If a smooth coat is desired, a continuous blade extending over the entire width of the web must be used, since a comb-like blade would allow excess coating mix to leak between the slits of the blade onto the web. The excess coating then forms streaks on the coat. Constructions based on flexible and adjustable doctor blade holders are complicated; blade replacement in the holders is cumbersome and the flexible members may break during blade replacement. The blade holder must be designed large and heavy in structure.

SUMMARY OF THE INVENTION

The aim of this invention is to achieve a novel method for the compensation of doctor blade deflection. A deflection-compensated doctor blade can be attained by applying the method in accordance with the invention. Moreover, the invention aims to achieve such a doctor blade construction which can also perform as a scraper blade for the cleaning of a roll or drying cylinder.

The invention is based on achieving a compensating deformation of the blade, which counteracts the deformation of the doctor blade caused by blade loading, by means of an actuator element arranged in a position displaced from the pivotal axis.

The invention provides outstanding benefits.

The aim of the present invention is to achieve a doctor blade construction in which the doctor blade stays parallel with the web and the backing roll even at high blade loads. Increased coating speed becomes thereby possible, while still achieving a high-quality coating with a variety of different coating mix formulas. The doctor blade construction in accordance with the invention provides for an easy control and wide range of blade adjustment. The blade loading is homogeneous over the entire length of the doctor blade. This means that the force exerted by the doctor blade on the backing roll or cylinder can be brought to its optimum value—within the limitations of materials and coating speed—without deviation from this value at any point along the blade. The doctor blade can in all circumstances be pivotally mounted along the axis of its center of gravity, whereby the position of the doctor blade axis becomes independent of the blade's operating position and blade shape errors developed during its fabrication are minimized.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this description.

BRIEF DESCRIPTION OF THE DRAWINGS

The invention is next examined in detail with the help of an exemplifying embodiment illustrated in the attached drawings which are given by way of illustration only, and thus are not limitative of the present invention. and wherein.

DETAILED DESCRIPTION OF THE PREFERRED EMBODIMENT

Figure 1:
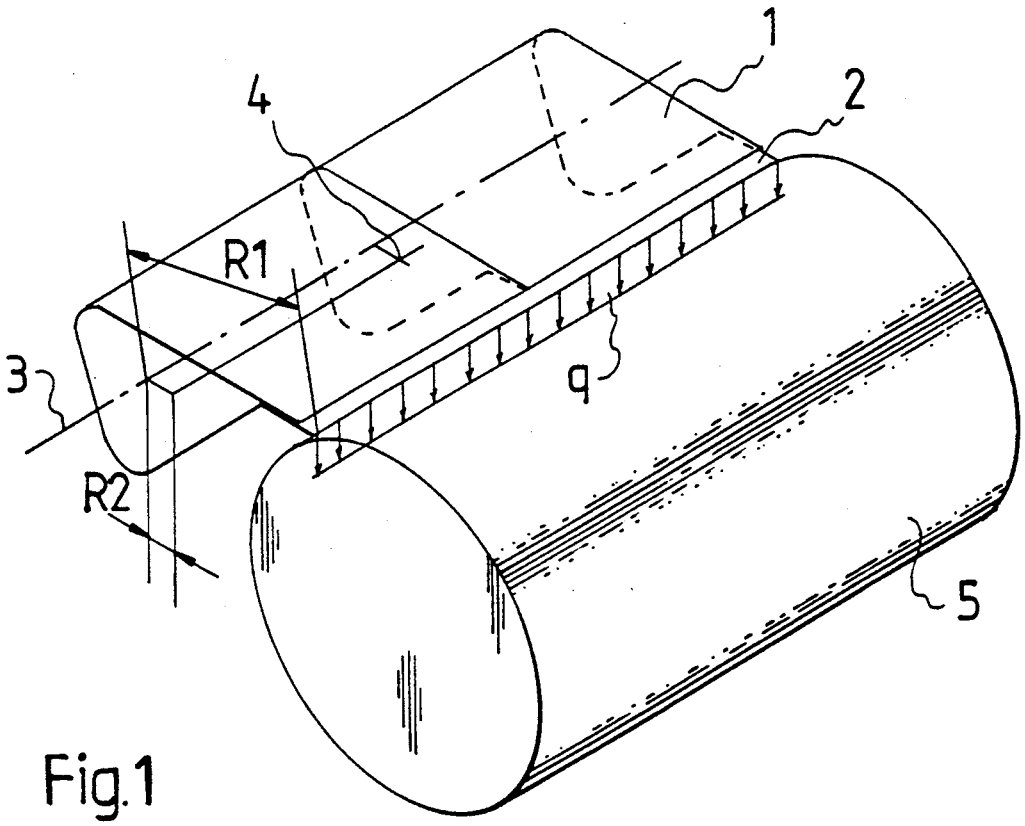
FIG. 1 represents in a diagrammatic form a doctor unit with its doctor blade holder, doctor blade, backing roll and the loading caused on the blade by its inherent mass.

Illustrated in FIG. 1 is a doctor blade 1 pivotally mounted along and supported by bearings placed on an axis 3. A blade edge 2 of the doctor blade 1 is loaded by a linear force q exerted by the inherent mass of the doctor blade. The magnitude of the linear force q can be determined by computational means when the mass of the doctor blade per linear unit, together with the distance R2 of the gravity point 4 of the doctor blade 1 from the pivotal axis 3 as well as the distance R1 from the edge of the blade 2 to the pivotal axis 3, are known. In order to obtain a linear loading caused by the mass of the doctor blade 1, the contours of the doctor blade 1 and the surface of a backing roll 5 must be compatible, which in this case means straight and parallel shapes. The edge of the doctor blade 1 and the surface of the backing roll 5 have compatible and parallel contours if the doctor blade 1 is machined in a position simulating its operation position and is well supported at the attachment edge of the blade holder using several supports exerting equal forces.

Figure 2:
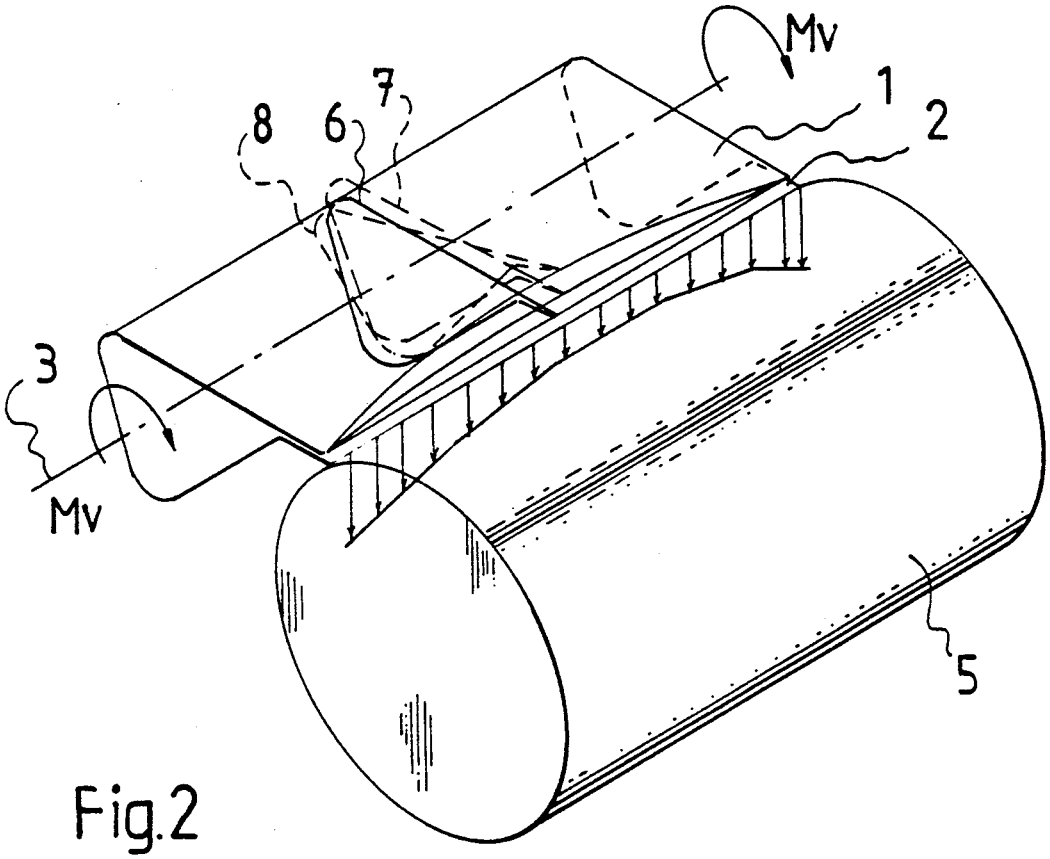
FIG. 2 shows the load exerted on the blade during the loading of the doctor blade as well as the deflections at the center of the doctor blade caused by the loading.

The blade loading force q caused by the inherent mass of the doctor blade 1 is not sufficient in all conditions for the doctoring of the coating mix, and blade load control without an actuator means is impossible. Therefore, the adjustment of blade loading is implemented with the help of an opening actuator cylinder of the doctor blade structure 1. A torsional moment Mv is applied at the ends of the doctor blade structure 1 by means of the opening actuator cylinder. The total blade loading caused by the torsional moment Mv can then be written:

$qL = 2Mv/R1$, where $2Mv$ = sum of torsional moments $R1$ = distance of blade edge from the pivotal axis $L$ = doctor blade width Loading the doctor blade 1 in this manner results in a nonhomogeneous linear loading force q of the blade. A loaded beam (in this case, the doctor blade 1), which is supported at both ends, has the maximum deflection at its center. The loading force q of the blade is then as shown in FIG. 2. Illustrated along the entire length of the blade in FIG. 2 are the deflection of the blade edge 2 caused by the loading force q as well as the deviation of the cross-section at the center of the doctor blade 1. Indicated by a solid line is a cross-section 6 for the position of the center of the doctor blade 1 in an unloaded situation. A cross-section 7 indicated by a dashed line shows the vertical deflection caused by the blade bending, while a cross-section 8 illustrates the deflection caused by the combination of bending and torsion.

As shown in FIG. 2, the gap between the blade edge 2 and the backing roll 5 is not constant over the length of the blade. The deflection of the edge 2 of the doctor blade 1 away from the surface of the roll 5 becomes larger toward the center of the blade 1, with a resultant increase in the gap between the blade edge 2 and the roll 5. The deflected shape of the blade edge 2 shown in FIG. 3 obeys the deflection profile resulting in the doctor blade 1 from the combination of the torsional moment Mv and the blade loading force q. The deflection profile of the frame of the doctor blade 1 is easy to determine by using computation formulas derived for a beam supported at both ends under different loading conditions. These formulas are readily available in basic tutorials or handbooks of structural analysis.

As soon as the deflection profile of the doctor blade 1 is determined, the force and its acting point for the compensation of stresses and deflection can be determined. The magnitude and acting point of the force are set to exert on the doctor blade 1 such deflections that are approximately equal in magnitude but acting in the opposite direction to those caused by the loading. A deflection profile 10 resulting from a properly selected force has then an approximately similar shape with a deflection profile 9 resulting from the loading of the doctor blade 1. When the loading forces and the compensating force are superimposed on the doctor blade 1, a straight deflection profile 11 results with its shape corresponding to the original contour of the blade.

Figure 3:
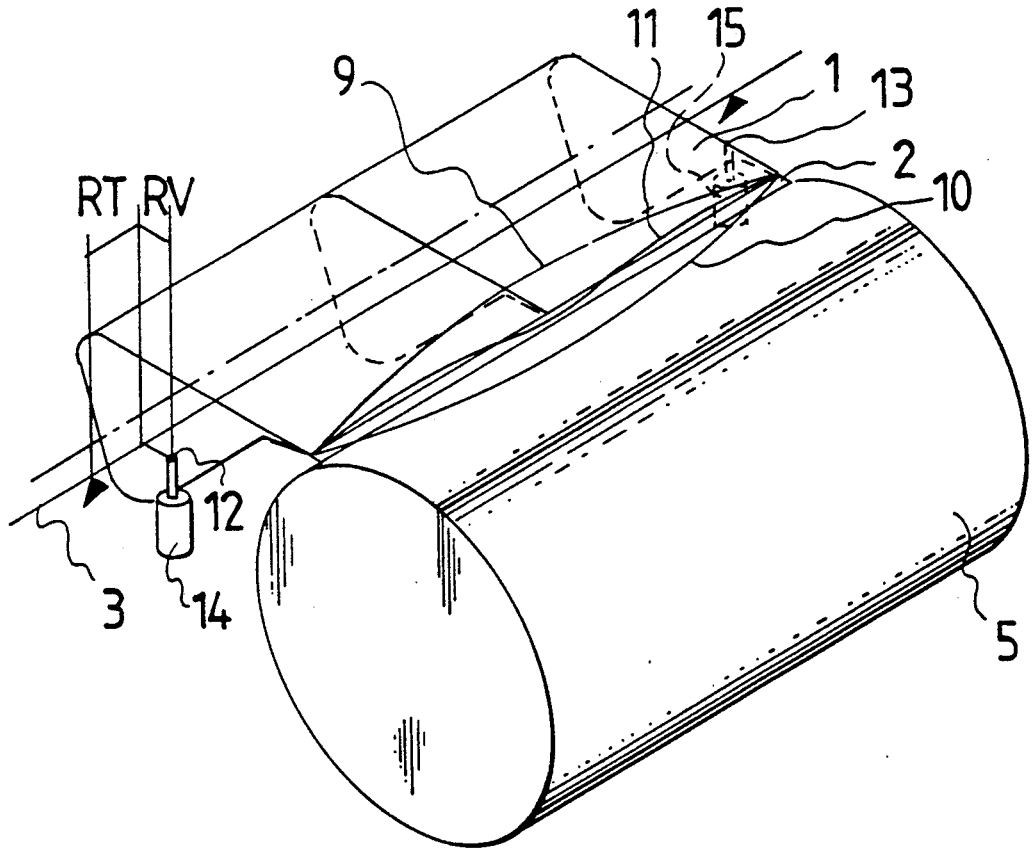
FIG. 3 shows the initial deflection profile, the compensation force-exerted deflection profile as well as the deflection profile resulting from their combination in the loading situation illustrated in FIG. 2.

The compensating force is obtained by means of loading actuator cylinders 14 and 15 of the doctor blade structure. The cylinders 14 and 15 are placed between the bearing points of the doctor blade and displaced from the pivotal axis 3 of the edge 2 of the doctor blade 1 toward the side of the edge 2 of the doctor blade 1. The cylinders 14 and 15 must be aligned parallel to the direction of the blade loading force q. Shown in FIG. 3 is a possible placement of the cylinders 14 and 15. The cylinders 14 and 15 are thus placed at points 12 and 13. These points are spaced by a distance RT from the support bearings and by a distance RV from the pivotal axis 3 of the doctor blade structure 1 toward the blade edge 2. These lever arms RV and RT determine the torsional moments imposed on the doctor blade structure by the actuator cylinder force. The lever arm ratio Vs can be computed from the deflection caused by the loading, resulting in an appropriate lever arm ratio:

$Vs = 80L/368R1$, where $L$ = doctor blade width $R1$ = distance of doctor blade edge from the pivotal axis of the doctor blade Of the two lever arms, RV determines the loading force of the blade, while RT exerts the bending force on the blade 1. With a proper selection of the lever arms RT and RV, the edge 2 of the doctor blade 1 can be maintained straight and the blade loading force constant over a wide range of adjustment.

The theoretical degree of compensation attainable with this method is not complete, since the loading actuator cylinders exert on the doctor blade such a compensating torsional moment with a constant magnitude: that results in a deflection profile with a circular shape. By contrast, a linear blade loading force results in a parabolically shaped deflection profile. In a practical application operating with a small deflection relative to the entire blade length, the difference between these two curve shapes is so small that in the exemplifying case the resultant error is only 5% in relation to the case without compensation. Adherence to the lever arm ratio described in the above paragraph results in a minimized error between the circular and parabolic shapes of the profiles.

In the embodiment described hereinwith, the loading actuator cylinders are located between the pivotal axis 3 and the blade edge 2 of the doctor blade structure 1. Alternatively, the cylinders can be arranged on the opposite side of the pivotal axis, wherein their direction of action must be inverted in relation to that shown in the above embodiment. The actuator cylinders exerting the compensating and adjustable loading force can be, e.g., pneumatic actuator cylinders, electrically-powered ball circulating nut and screw combinations or any other actuator means with a sufficient accuracy in the control of position and exerted force.

In order to clarify the principle of the present invention in depth, a simple dimensioning case of a deflection-compensated doctor blade construction is given below. The actuator means used in the exemplifying embodiment is comprised of two pneumatic actuator cylinders.

The symbols and initial values are:

q=120 N/m, mean value of blade loading force

L=5 m, width of the doctor blade

R1=0.3 m, distance of the blade edge 2 from the pivotal axis 3 of the doctor blade RV=0.07 m, distance of acting points 12 and 13 of the exerted actuator cylinder force from the pivotal axis p=450 kPa (4.5 bar), working pressure of hydraulic system Fs=force exerted by actuator cylinder D=diameter of actuator cylinder Vs=RT/RV, ratio of force lever arms The required actuator cylinder force is first determined:

$$FS=qLR1/2RV=120\ N/m \times 5\ m \times 0.3\ m/2\times 0.07\ m$$
$$=128S\ N$$

The cylinder diameter is solved $$Ds = 4Fs/p = 4 \times 1285\ N/450\ 000\ \text{Pa} = 0.06\ \text{m} => \text{cylinder diameter 63 mm will be selected}$$

$$\textit{Arm ratio: } Vs=RT/RV=80L/384R1=80\times 5\ m/384\times 0.3=3.5$$

$$\textit{Torsional force arm length } RT \textit{ is: } 3.5\times 0.07=0.25\ m$$

Thus, the dimensional deformations imposed on the doctor blade structure are opposite in their effect and result in mutual compensation to a very high degree. As shown in FIG. 3, the resultant deflection profile 11 has a clearly better straightness than the deflection profile 9 resulting from the omission of compensation. In practical conditions the residual error after compensation is much smaller than, e.g., the straightness and installation tolerances of the backing roller surface.

What is claimed is:

1. A method for the compensation of deflection of a doctor blade and for the scraping of a backing member, in which method the deformation imposed on a doctor blade structure by blade loading force pressing an edge of the doctor blade of the doctor blade structure against a backing member is compensated, the method comprising the step of compensating the deformation caused by the blade loading force by imposing a discrete, non-continuous compensating force on at least one point of the doctor blade structure in such a manner that:

said compensating force is brought to act on one hand at a first distance from a pivotal support point of the doctor blade structure and on the other hand at a second distance from a pivotal axis of the doctor blade structure, while the compensating force is aligned generally parallel with the blade loading force, wherein magnitude and arms of action of the compensating force from the pivot support point are dimensioned so as to achieve a deflection of the doctor blade structure which is generally equal in magnitude with that caused by the blade loading force but having an opposite direction, whereby the deflections generally cancel each other, allowing the edge of the doctor blade to be maintained generally parallel with the contour of the backing member.

2. The method in accordance with claim 1, wherein the compensating force is arranged to be exerted on the doctor blade structure so that one arm of action is placed to the same side with the edge of the doctor blade as seen along the pivotal axis of the doctor blade structure.

3. The method in accordance with claim 1, wherein the compensating force is arranged to be exerted on the doctor blade structure so that one arm of action is placed to the opposite side of the edge of the doctor blade as seen along the pivotal axis of the doctor blade structure.

4. A method for the compensation of deflection of a doctor blade and for scraping a backing member, the doctor blade having a pivotal support point through a pivotal axis thereof, the method comprising the steps of:

pressing an edge of the doctor blade against the backing member, a blade loading force thereby being imposed on the doctor blade by the backing member;

imposing a discrete, non-continuous compensating force on at least one position of the doctor blade, the doctor blade having a given width and length and each of the at least one position at which the compensating force is applied being less than one half the width and less than half the length of the doctor blade;

applying the compensating force during the step of compensating at a first distance from the pivotal support point of the doctor blade and at a second distance from the pivotal axis of the doctor blade while the compensating force is aligned generally parallel with the blade loading force; and dimensioning magnitude and arms of action of the compensating force from the pivot support point to achieve a deflection of the doctor blade generally equal in magnitude to the deflection caused by the blade loading force but having an opposite direction, whereby the deflections generally cancel each other thereby allowing the edge of the doctor blade to be maintained generally parallel with the contour of the backing member.

5. The method in accordance with claim 4, further comprising the step of arranging the compensating force exerted on the doctor blade so that one arm of action is placed on a same side as the edge of the doctor blade as seen along the pivotal axis of the doctor blade structure.

6. The method in accordance with claim 4, further comprising the step of arranging the compensating force exerted on the doctor blade structure so that one arm of action is placed on an opposite side of the edge of the doctor blade as seen along the pivotal axis of the doctor blade structure.

7. The method in accordance with claim 4, wherein the step of imposing comprises applying the compensating force at two separate discrete points of the doctor blade.

* * * * *